US006532950B2

(12) United States Patent
Meurer

(10) Patent No.: US 6,532,950 B2
(45) Date of Patent: Mar. 18, 2003

(54) FIRE RING ASSEMBLY

(76) Inventor: Robert Meurer, 1875 Olson Dr., P.O. Box 27, Chippewa Falls, WI (US) 54729

( * ) Notice: Subject to any disclaimer, the term of this patent is extended or adjusted under 35 U.S.C. 154(b) by 0 days.

(21) Appl. No.: 09/932,024

(22) Filed: Aug. 20, 2001

(65) Prior Publication Data

US 2003/0034023 A1 Feb. 20, 2003

(51) Int. Cl.[7] ..... F24C 1/16
(52) U.S. Cl. ..... 126/29; 126/9 R
(58) Field of Search ..... 126/29, 30, 9 R, 126/9 B, 25 R, 201, 38

(56) References Cited

U.S. PATENT DOCUMENTS

| | | | | | |
|---|---|---|---|---|---|
| 1,221,514 | A | * | 4/1917 | Crain | 126/29 |
| 1,238,142 | A | * | 8/1917 | Hitchcock | 126/29 |
| 2,965,097 | A | * | 12/1960 | Clark | 126/30 |
| 3,146,773 | A | * | 9/1964 | Melzer | 126/9 R |
| 4,363,313 | A | | 12/1982 | Smith | 126/9 R |
| 4,829,977 | A | * | 5/1989 | Valentine | 126/9 R |
| 4,971,045 | A | | 11/1990 | Probst | 126/9 R |
| 5,329,917 | A | | 7/1994 | Young | 126/29 |
| 5,682,872 | A | | 11/1997 | Whitted | 126/29 |
| 5,711,210 | A | | 1/1998 | Kaufman | 126/9 R |
| 5,785,046 | A | | 7/1998 | Colla | 126/9 R |
| 6,425,387 | B1 | * | 7/2002 | Rohback, Jr. | 126/9 R |

FOREIGN PATENT DOCUMENTS

| | | | |
|---|---|---|---|
| GB | 308104 | A * | 3/1929 |
| JP | 11-337071 | A * | 10/1999 |

* cited by examiner

*Primary Examiner*—Henry Bennett
*Assistant Examiner*—Josiah Cocks
(74) *Attorney, Agent, or Firm*—Manelli Denison & Selter; Edward J. Stemberger

(57) ABSTRACT

A portable fire ring assembly includes at least three substantially identically configured curved ring sections. Each ring section has a body defined by an upper edge, a lower edge and opposing ends. Each end includes a pair of engaging structures extending therefrom. Each engaging structure includes a male member and a female member, whereby male members of one ring section are removably engagable with female members of another of the ring sections such that the ring sections may be joined to define a ring sized to surround a campfire.

8 Claims, 2 Drawing Sheets

FIRE RING ASSEMBLY

FIELD OF THE INVENTION

This invention relates to surrounding a campfire to contain the fire and, more particularly, to portable fire ring.

BACKGROUND OF THE INVENTION

Typically, campers create a fire pit or use a circle of rocks to surround a fire so as to keep the fire from spreading due to wind or from logs that can move in the fire. Oftentimes, it is difficult to find enough rocks of sufficient size at the campsite to create a circle of rocks. Alternatively, digging a fire pit is cumbersome work.

A portable fire ring is disclosed in U.S. Pat. No. 5,329,917. The ring includes a plurality of sections that are joined to form a fire ring and an attached cooking area. Although the fire ring is effective for surrounding a fire, the many components of different sizes and shapes increase the cost of manufacturing and assembly time. Furthermore, due to the number of components, a carry bag must be used to transport the fire ring.

Accordingly, there is a need to provide a fire ring assembly which is easy to manufacture, assemble and transport.

SUMMARY OF THE INVENTION

An object of the invention is to fulfill the need referred to above. In accordance with the principles of the present invention, this objective is obtained by providing a portable fire ring assembly including at least three substantially identically configured curved ring sections. Each ring section has a body defined by an upper edge, a lower edge and opposing ends. Each end includes a pair of engaging structures extending therefrom. Each engaging structure includes a male member and a female member, whereby male members of one ring section are removably engagable with female members of another of the ring sections such that the ring sections may be joined to define a ring sized to surround a campfire.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE PREFERRED EMBODIMENT

Figure 1:
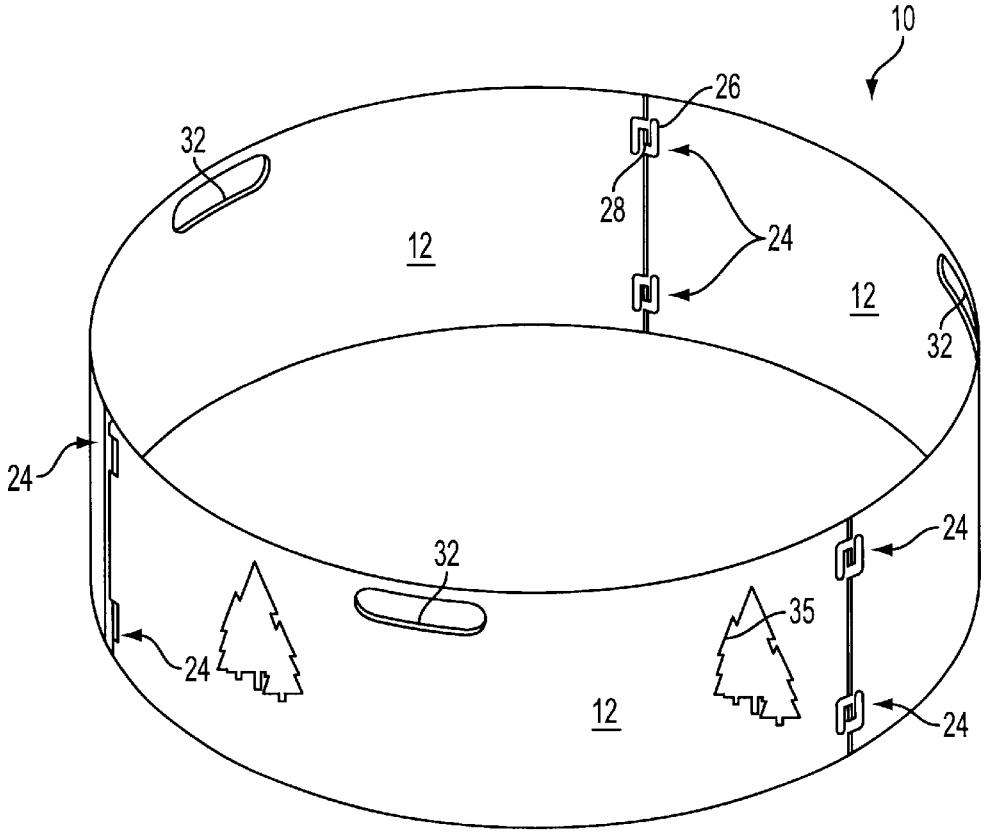
FIG. 1 perspective view of a fire ring assembly, provided in accordance with the principles of the present invention, shown in an assembled condition.
Figure 3:
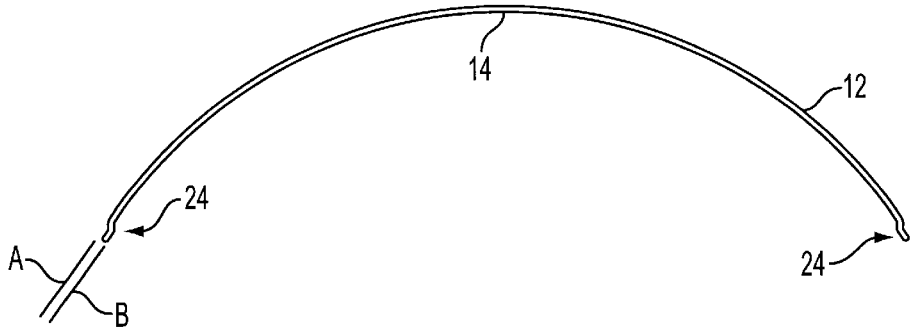
FIG. 3 is a top view of a ring section of FIG. 1, shown after a being rolled into a curved section.

With reference to FIG. 1, a fire ring assembly, generally indicated at 10 and provided in accordance with the principles of the present invention, is shown in an assembled condition. The portable fire ring assembly 10 includes at least three identically configured curved ring sections 12. For larger fire pits, more than three ring sections can be employed. With reference to FIG. 3, preferably, each ring section 12 comprises sheet of 14 gage HRS that is rolled define a curved section.

Figure 2:
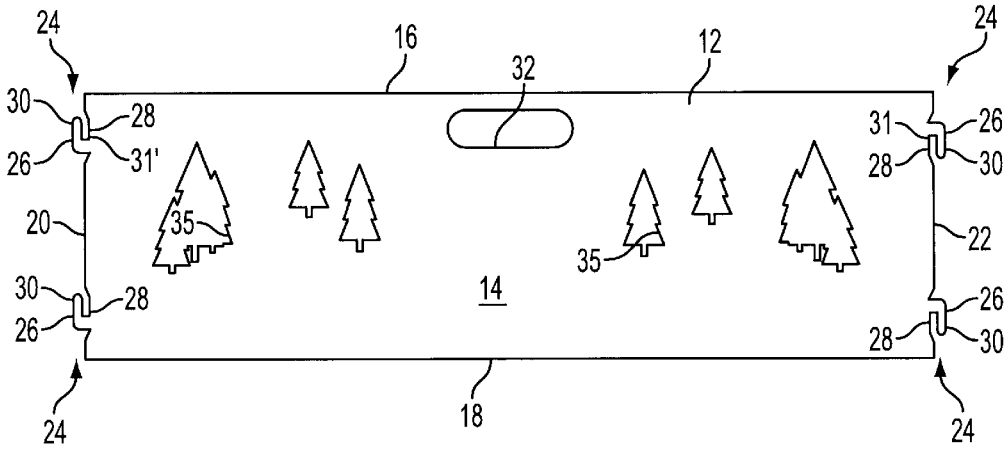
FIG. 2 is a front view of a ring section of the fire ring assembly of FIG. 1 shown before being rolled into a curved section.

As best shown in FIG. 2, each ring section 12 has a body 14 defined by an upper edge 16, a lower edge 18 and opposing ends, 20 and 22. Each end 20 and 22 includes a pair of engaging structures, generally indicated 24, extending therefrom. Each engaging structure 24 includes a male member 26 and a female member 28. In the illustrated embodiment, each male member 26 is generally L-shaped to define a protruding element 30. Each female member 28 includes surfaces defining a cutout generally adjacent to the protruding element 30. The male members 26 and the cutouts defining the female members 28 are generally rectangular. The protruding elements 30 of a pair of engaging structures 24 extend upwardly from one end 20 of each ring section and protruding elements 30 of the other pair of engaging structures 24 extend downwardly from the other end 22 of each ring section 12. With this configuration, male members 26 of one ring section are removably engagable with female members 28 of another of ring section such that the ring sections may be joined to define the fire ring assembly 10 sized to surround a campfire 9 (e.g., about 30 inches in diameter). More particularly, downwardly facing surface 31 of an engaging structure 24 of one ring section 12 engages the upwardly facing surface 31' of engaging structure 24 of another ring section 12.

Each ring section 12 is punched or cut by a laser. Thereafter, the engaging structures are formed. As best shown in FIG. 3, for ease of assembly, each engaging structure 24 is bent so as to be disposed in a plane B offset from a plane A of the body 14. Finally, the entire ring section 12 is rolled to define the curved shape.

As shown in FIGS. 1 and 2, each ring section 12 has a cutout defining a handle 32 near the upper edge 16. Thus, in an unassembled condition of the fire ring assembly 10, the ring sections 12 are stackable such that the handles 32 align so all ring sections 12 can be carried simultaneously.

It can be appreciated that since each ring section 12 is substantially identically configured, manufacturing costs are reduced. Furthermore, transporting the fire ring assembly 10 is easy since each section 12 has a handle.

If desired, the body 14 any ring section 12 can include decorative cutouts 35 there-through permitting light and heat from the fire to pass through the cutouts 35. Furthermore, a grill (not shown) can be placed over the upper edges 16 so that campers can use the fire ring assembly for cooking.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A portable fire ring assembly comprising:

at least three substantially identically configured curved ring sections, each ring section having a body defined by an upper edge, a lower edge and opposing ends, each end including a pair of engaging structures extending therefrom, each engaging structure including a male member and a female member, whereby male members of one ring section are removably engagable with female members of another of said ring sections such that the ring sections may be joined to define a ring sized to surround a campfire, wherein each male member is generally L-shaped to define a protruding element, and each female member includes surfaces defining a cut-out generally adjacent to the protruding element, and wherein the protruding elements of a pair of engaging structures extend upwardly from one end of each ring section and protruding elements of the other pair of engaging structures extend downwardly from the other end of each ring section.

2. The fire ring assembly of claim 1, wherein each ring section comprises sheet metal rolled to define a curved configuration.

3. The fire ring assembly of claim 1, wherein each engaging structure is bent so as to be offset from the body.

4. The fire ring assembly of claim 1, wherein each ring section has a cutout defining a handle near the upper edge.

5. The fire ring assembly of claim 4, wherein, in an unassembled condition of the fire ring assembly, each ring section is constructed and arranged to be stacked with respect to another said ring section.

6. The fire ring assembly of claim 1, wherein a body of at least one of the ring sections includes a decorative cutout therein to permit heat and light of the fire to pass therethrough.

7. A portable fire ring assembly comprising:

a plurality of substantially identically configured curved ring sections, each ring section having a body defined by an upper edge, a lower edge and opposing ends, each end including a pair of engaging structures extending therefrom, each engaging structure including a male member and a female member, each male member defining a protruding element, and each female member including surfaces defining a cutout generally adjacent to the protruding element, wherein the protruding elements of a pair of engaging structures extend upwardly from one end of each ring section and protruding elements of the other pair of engaging structures extend downwardly from the other end of each ring section, whereby male members of one ring section are removably engagable with female members of another of said ring sections such that the ring sections may be joined to define a ring sized to surround a campfire.

8. The fire ring assembly of claim 7, wherein a body of at least one of the ring sections includes a decorative cutout therein to permit heat and light of the fire to pass therethrough.

* * * * *